US005214476A

United States Patent [19]

Nomura et al.

[11] Patent Number: 5,214,476

[45] Date of Patent: May 25, 1993

[54] IMAGE FORMING APPARATUS

[75] Inventors: Noriyoshi Nomura; Masahiko Asada, both of Gifu, Japan

[73] Assignee: Sanyo Electric Co., Ltd., Osaka, Japan

[21] Appl. No.: 792,005

[22] Filed: Nov. 14, 1991

[30] Foreign Application Priority Data

Nov. 16, 1990 [JP] Japan ..... 2-311904

[51] Int. Cl.[5] ..... G03G 21/00

[52] U.S. Cl. ..... 355/246; 355/204; 355/208; 222/DIG. 1; 118/689; 395/900

[58] Field of Search ..... 355/246, 208, 204, 203; 118/689-691; 222/DIG. 1; 395/900, 906

[56] References Cited

U.S. PATENT DOCUMENTS

| | | | |
|---|---|---|---|
| 3,572,551 | 3/1971 | Gillespie | 118/689 X |
| 3,698,926 | 10/1972 | Furuichi | 118/689 X |
| 3,928,764 | 12/1975 | Bock et al. | 118/690 X |
| 4,342,283 | 8/1982 | Terashima | 118/689 |
| 4,514,480 | 4/1985 | Wada et al. | 118/690 X |
| 4,734,737 | 3/1988 | Koichi | 355/246 X |
| 4,967,691 | 11/1990 | Chikama et al. | 118/689 X |
| 5,029,314 | 7/1991 | Katsumi et al. | 355/208 |
| 5,142,332 | 8/1992 | Osawa et al. | 355/208 |

FOREIGN PATENT DOCUMENTS

| | | | |
|---|---|---|---|
| 0029737 | 3/1978 | Japan | 118/689 |
| 0045277 | 3/1985 | Japan | 355/246 |
| 0057873 | 4/1985 | Japan | 355/246 |
| 0055673 | 3/1986 | Japan | 355/246 |
| 0153673 | 7/1986 | Japan | 355/246 |
| 0153675 | 7/1986 | Japan | 355/246 |
| 0235873 | 10/1986 | Japan | 355/246 |
| 0109078 | 5/1987 | Japan | 355/246 |
| 0113179 | 5/1987 | Japan | 355/246 |

*Primary Examiner*—A. T. Grimley
*Assistant Examiner*—Matthew S. Smith
*Attorney, Agent, or Firm*—Darby & Darby

[57] ABSTRACT

An image forming apparatus includes a developing unit for toner-developing a latent image formed on a photoreceptor, and a dual-component developer consisting of carrier particles and toner particles is contained in the developing unit. A toner concentration in the developing unit is sensed by a magnetic sensor. An output voltage of the magnetic sensor is applied to a microcomputer through an analog-to-digital converter. The microcomputer sets a toner supply time in accordance with a fuzzy inference based on the output voltage of the magnetic sensor and a change amount of the output voltage of the magnetic sensor. A toner supply motor is driven for the set time. Consequently, the toner supply roller supplies toner particles to the developing unit from a toner box.

14 Claims, 8 Drawing Sheets

TONER IS DECREASING ← → TONER IS INCREASING

CHANGE IN OUTPUT OF MAGNETIC SENSOR

TONER CONCENTRATION: LOW ↑ / HIGH ↓

OUTPUT OF MAGNETIC SENSOR

| | NL | NM | NS | ZR | PS | PM | PL |
|---|---|---|---|---|---|---|---|
| NL | PL | | PL | PL | | PL | |
| NM | | PL | PL | PM | ③ | PM | |
| NS | PL | PL | ② | PS | | | PL |
| ZR | PL | ① | ZR | NS | | NM | |
| PS | PM | | NM | | NL | | PS |
| PM | | | | NL | | | |
| PL | | | | | | | |

IMAGE FORMING APPARATUS

BACKGROUND OF THE INVENTION

1. Field of the Invention

The present invention relates generally to an image forming apparatus. More particularly, the present invention relates to an image forming apparatus, such as an electrophotographic copying machine, a laser printer, etc. in which an electrostatic latent image formed on a photoreceptor is toner-developed by using a dual-component developer consisting of carrier particles and toner particles.

2. Description of the Prior Art

As described in, for example, U.S. Pat. No. 5,012,286 and U.S. Pat No. 4,956,668, in this type of image forming apparatus, constant amounts of toner particles are supplied only when a toner concentration sensor senses that a toner concentration is not more than a predetermined value. Consequently, the toner concentration temporarily varies until such value is sensed. In the conventional image forming apparatus, therefore, there occurs a decrease in image quality due to the variation in the toner concentration.

SUMMARY OF THE INVENTION

Therefore, a principal object of the present invention is to provide a novel image forming apparatus.

Another object of the present invention is to provide an image forming apparatus capable of maintaining a constant toner concentration.

An image forming apparatus according to the present invention comprises an electrostatic latent image carrying member for carrying an electrostatic latent image; developing means for developing the electrostatic latent image using a dual-component developer consisting of a mixture of toner particles and carrier particles; toner concentration sensing means for sensing a toner concentration in the dual-component developer; change amount calculating means for calculating a change amount of the toner concentration based on the toner concentration sensed by the toner concentration sensing means; toner supply amount setting means for setting a toner supply amount based on the change amount of the toner concentration calculated by the change amount calculating means and the toner concentration sensed by the toner concentration sensing means; and toner supplying means for supplying toner particles to the developing means in accordance with the set toner supply amount.

The toner supply amount for the toner supplying means is set based on the change amount of the toner concentration calculated by the change amount calculating means and the toner concentration sensed by the toner concentration sensing means. In a preferred embodiment, a fuzzy logic reasoning inference is used so as to determine the toner supply.

According to the present invention, the toner supply amount is set based on the change amount of the toner concentration and the toner concentration. Accordingly, the toner concentration is always kept constant. Consequently, no decrease in image quality due to the variation in the toner concentration occurs. If a fuzzy logic inference is used so as to determine the toner supply amount, the variation in the toner concentration can be further restrained.

According to the preferred embodiment, an image forming apparatus comprises an electrostatic latent image carrying member for carrying an electrostatic latent image; developing means for developing the electrostatic latent image using a dual-component developer consisting of a mixture of toner particles and carrier particles; toner concentration sensing means for sensing a toner concentration in the developer in the developing means; instructing means for instructing the sensing of a toner concentration by the toner concentration sensing means at every predetermined time; change amount calculating means for calculating a change amount of the toner concentration based on the toner concentration sensed by the toner concentration sensing means in response to the instruction of the instructing means; toner supply amount setting means for setting a toner supply amount based on the change amount of the toner concentration calculated by the change amount calculating means and the toner concentration sensed by the toner concentration sensing means; and toner supplying means for supplying toner particles to the developing means in accordance with the set toner supply amount.

In this embodiment, the instructing means is an interrupt routine which is executed at a predetermined time interval.

An image forming apparatus according to the preferred embodiment comprises an electrostatic latent image carrying member for carrying an electrostatic latent image; developing means for developing the electrostatic latent image using a dual-component developer consisting of a mixture of toner particles and carrier particles; toner concentration sensing means for sensing a toner concentration in the developer in the developing means; instructing means for instructing the sensing of a toner concentration by the toner concentration sensing means at every predetermined time; change amount calculating means for calculating a change amount of the toner concentration based on the toner concentration sensed by the toner concentration sensing means in response to instruction of the instructing means; toner supply amount setting means for setting a toner supply amount based on the change amount of the toner concentration calculated by the change amount calculating means and the toner concentration sensed by the toner concentration sensing means; determining means for determining whether or not the toner concentration is in a predetermined range; and toner supplying means for supplying toner particles to the developing means in accordance with the set toner supply amount when it is determined by the determining means that the toner concentration is in the predetermined range.

In this embodiment, when the toner concentration is below the predetermined range, the image forming operation, or process, is inhibited from being executed.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
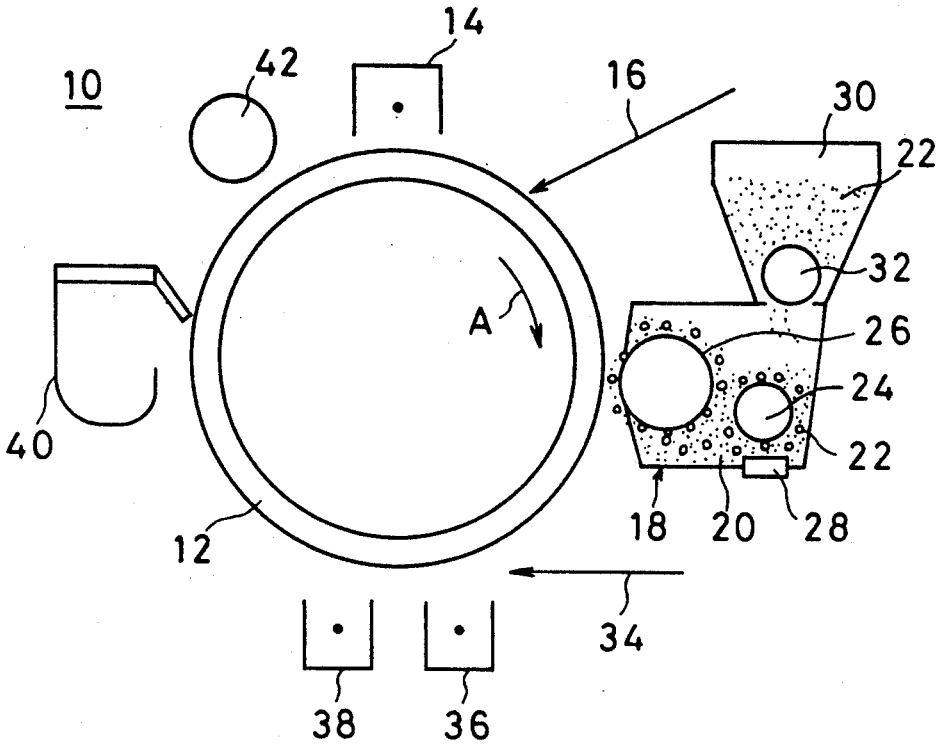
FIG. 1 is an illustrative view showing one example of an image forming apparatus which forms the background of the present invention and to which the present invention is applicable.

An image forming apparatus 10 according to the present embodiment shown in FIG. 1 includes a photoreceptor 12 serving as an electrostatic latent image carrying member, and a charging corotron 14 for uniformly charging the surface of the photoreceptor 12 is provided above the photoreceptor 12. An exposure unit (not shown) for irradiating exposure light 16 onto the photoreceptor 12 is disposed on the downstream side in the direction of rotation (indicated by an arrow A) of the photoreceptor 12. A developing unit 18 is provided on the downstream side of the position to which the exposure light 16 is irradiated. A dual-component developer consisting of a mixture of toner particles 20 and carrier particles 22 is contained in the developing unit 18, as is well known. An agitating roller 24 for agitating the developer and a developing roller 26 are contained in the developing unit 18. A magnetic sensor 28 for sensing a toner concentration in the developing unit 18 is provided below the agitating roller 24.

A toner box 30 is provided above the developing unit 18, and a toner supply roller 32 for supplying toner particles 20 from the toner box 30 to the developing unit 18 is mounted between the developing unit 20 and the toner box 30.

Furthermore, a transferring corotron 36 for transferring a toner image formed on the photoreceptor 12 by the developing unit 18 onto a recording paper 34 and a separating corotron 38 for separating the recording paper 34 from the photoreceptor 12 are respectively disposed below the photoreceptor 12.

Additionally, a cleaning unit 40 for removing the remaining toner particles on the photoreceptor 12 and an eraser lamp 42 for eliminating the remaining changes on the photoreceptor 12 are disposed on the downstream side of the separating corotron 38.

Figure 2:
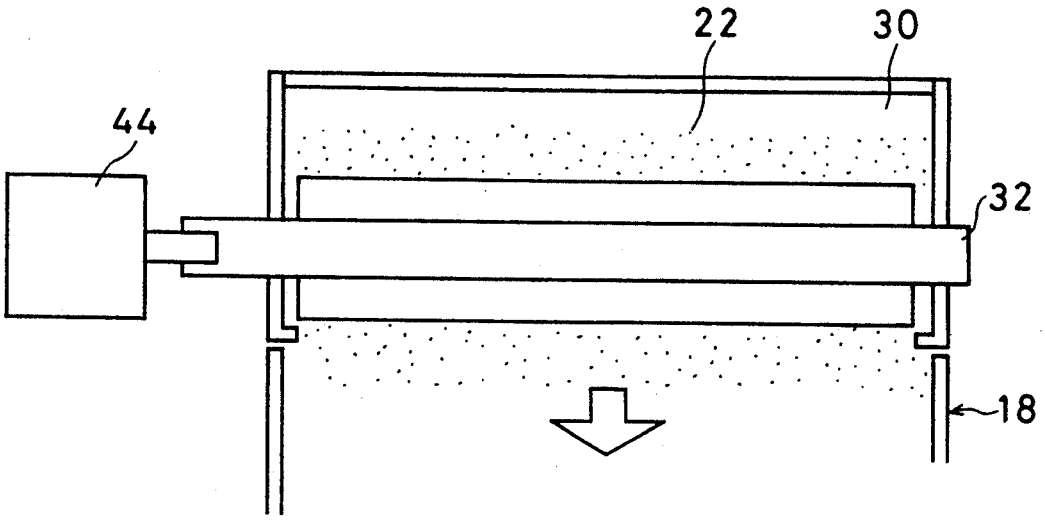
FIG. 2 is an illustrative view showing a toner box and associated components used in the image forming apparatus shown in FIG. 1.

Generally, when a dual-component developer is used, the mixing ratio (toner concentration) of the toner particles 20 to the carrier particles 22 in the developing unit 18 significantly affects the image density. In the present embodiment, the toner concentration is sensed by the magnetic sensor 28. The magnetic sensor 28 outputs a voltage value corresponding to a toner concentration by utilizing the phenomenon that permeability is decreased if the amount of toner particles is large, while being increased if it is small. If the toner supply roller 32 is rotated by driving a toner supply motor 44 shown in FIG. 2, the toner particles in the toner box 30 are dropped into the developing unit 18, so that the toner particles 20 can be supplied to the developing unit 18.

Figure 3:
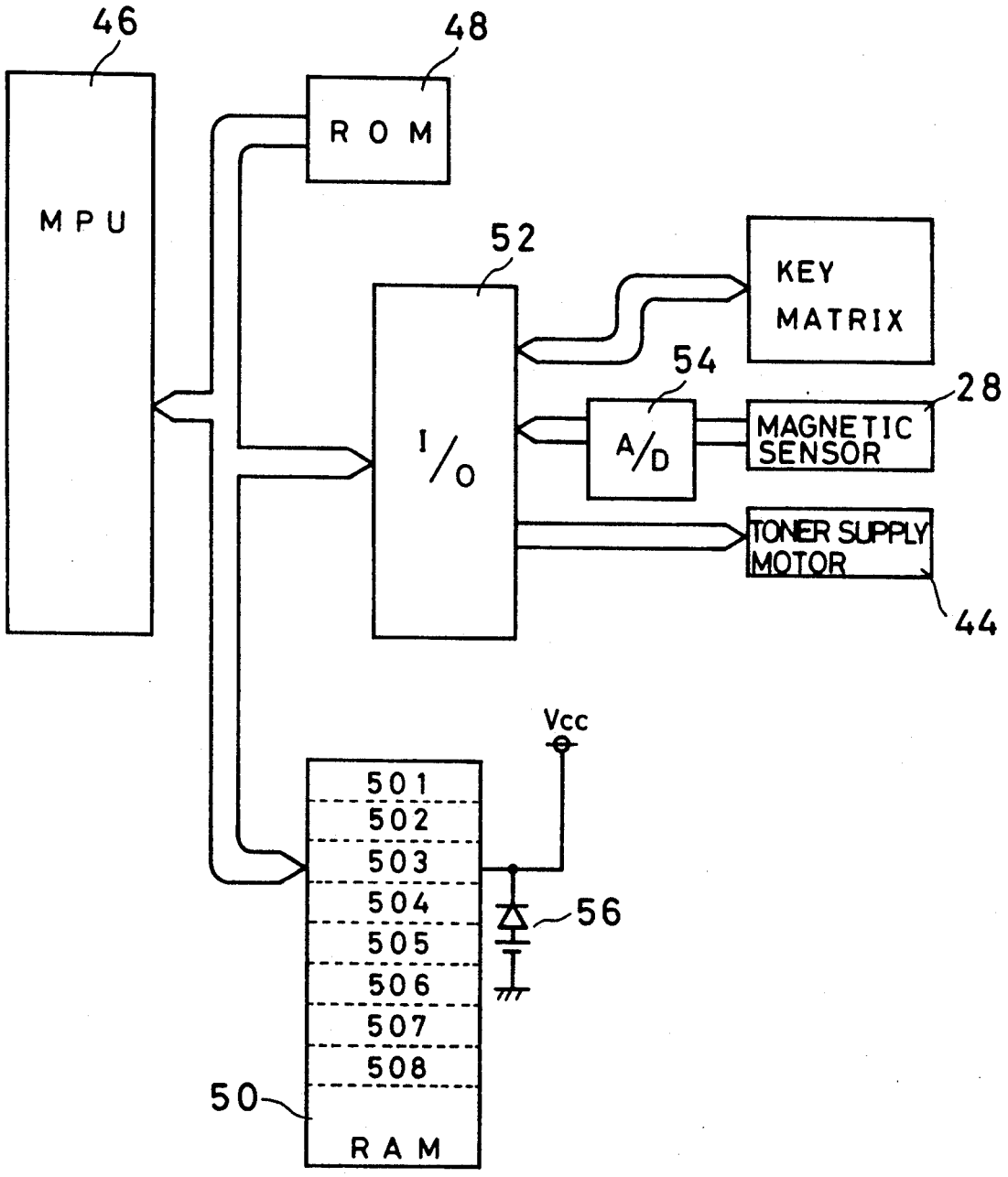
FIG. 3 is a block diagram showing the image forming apparatus shown in FIG. 1.

The image forming apparatus 10 shown in FIG. 1 is controlled by a microcomputer system including an MPU (microprocessor unit) 46 as shown in FIG. 3. The microcomputer system includes a ROM (read-only memory) 48 connected to the MPU 46 for storing, for example, a control program, membership functions and a look-up table for a fuzzy logic inference (both will be described later), a RAM (random access memory) 50 for temporarily storing data in the case of the control by the MPU 46 and having various flag areas required for the control, an I/O interface 52, and an analog-to-digital converter 54 for converting an output voltage of the magnetic sensor 28 into a digital value. The RAM 50 is backed up by a backup battery 56 such as a lithium battery connected to a supply voltage Vcc. That is, when the voltage Vcc is not supplied, a voltage of the backup battery 56 is applied to the RAM 50. Consequently, even if a main power switch (not shown) of the image forming apparatus 10 (see FIG. 1) is turned off, the data in the RAM 50 is held. Areas 501 to 508 are formed in the RAM 50. The area 507 is utilized as a counter, and the area 508 is utilized as a flag. In addition, an output of the above described analog-to-digital converter 54 is provided to an input port of the I/O interface 52. Also, a toner supply motor 44 for supplying toner particles to the developing unit 18 is connected to an output port of the I/O interface 52.

Figure 4A:
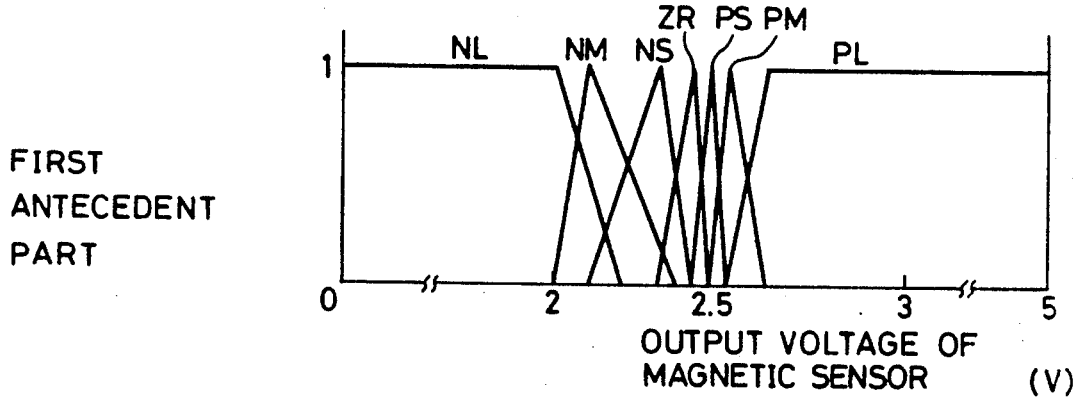
FIGS. 4A and 4C are illustrative views showing membership functions in a first antecedent part, a second antecedent part and a consequent part, respectively.
Figure 4B:
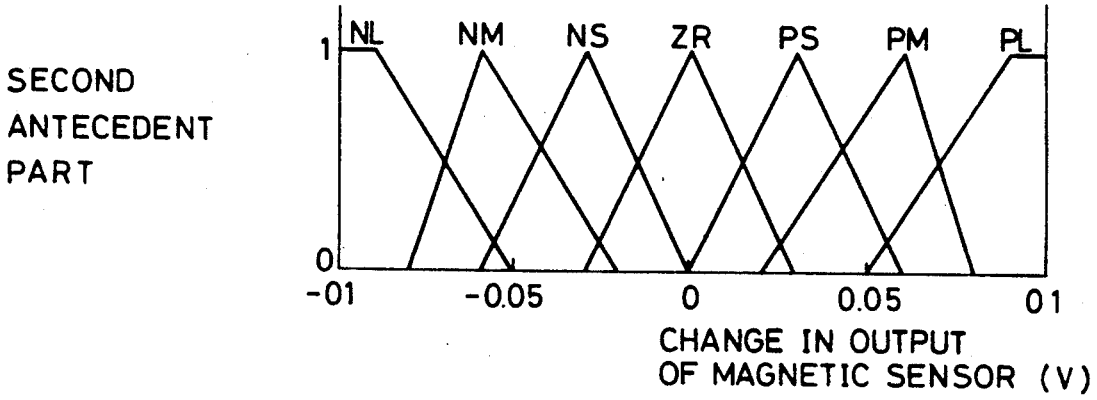

In this embodiment shown, a toner supply time is determined using a fuzzy inference from the absolute value of the toner concentration (the output voltage of the magnetic sensor 28) and the change amount of the toner concentration (the change amount of the output voltage of the magnetic sensor 28) such that the toner concentration in the developing unit 18 converges to 6.5% that is, the output voltage of the magnetic sensor 28 converges to 2.3 V. This fuzzy logic inference is of a two input and one output type consisting of two antecedent parts and one consequent part. The output voltage of the magnetic sensor 28, that is, the toner concentration is used as the first antecedent part. The results of experiments show that the membership functions may be thickly set when the output voltage is in the range of 2.4 to 2.5 V, while being thinly set as the output voltage deviates from this range such that the output voltage of the magnetic sensor 28 converges to 2.3 V in the first antecedent part, as shown in FIG. 4A. In addition, the change amount of the output voltage of the magnetic sensor 28, that is, the change amount of the toner concentration is used in the second antecedent part. The results of the experiments show that the membership functions may be set so as to be distributed in a relatively uniform manner in the second antecedent part, as shown in FIG. 4B. The toner supply time is used in the consequent part. The membership functions in the consequent part is thickly set in a region where the supply time is short, while being thinly set in a region where the supply time is long, as shown in FIG. 4C.

Figure 4C:
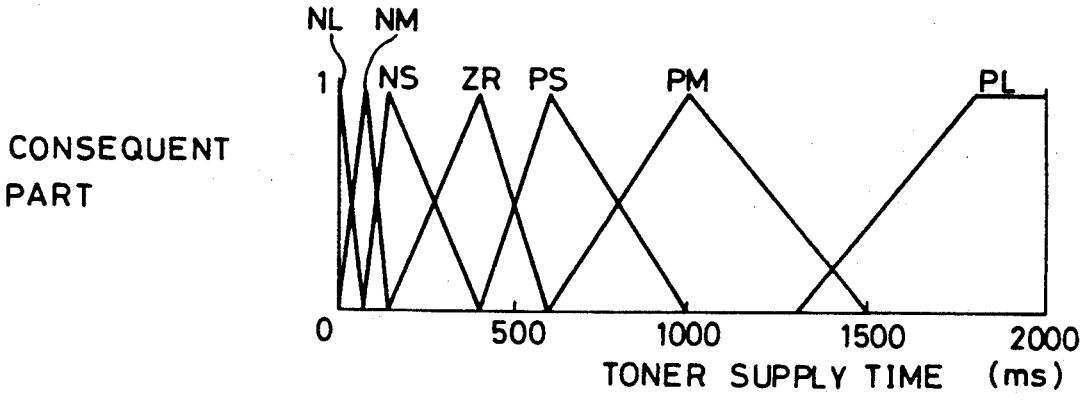

In FIGS. 4A to 4C, "PL", "PM", "PS", "ZR", "NL", "NM", and "NS" respectively represent "Positive Large", "Positive Medium", "Positive Small", "Zero", "Negative Large", "Negative Medium", and "Negative Small". The same is true in FIG. 5.

Figures 5, 6:
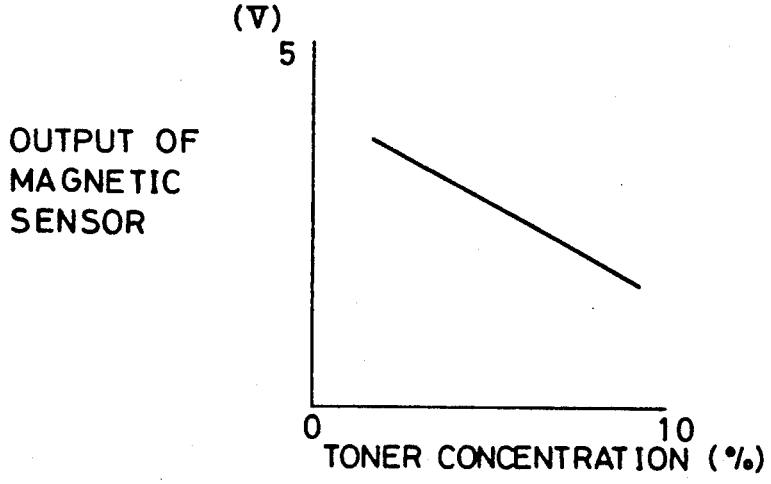
FIG. 5 is an illustrative view showing rules in a fuzzy logic reasoning inference.
FIG. 6 is a graph showing the relationship between a toner concentration and an output voltage of a magnetic sensor.

21 rules are made, as shown in FIG. 5, on the basis of the membership functions shown in FIGS. 4A to 4C. The meaning of the rules is as follows. Inherently, the supply time is increased at the lower toner concentration, while the supply is stopped when the toner concentration reaches the target value of the toner concentration. Furthermore, in the case of approximately the same toner concentration, when the change amount of the toner concentration is decreased, the supply amount is made larger than that in a case where the change amount of the toner concentration is increased. However, when the change amount of the output voltage of the magnetic sensor 23 is large, by assuming that the toner consumption was large in the preceding developing and the toner particles will be consumed in a large amount in a subsequent developing, toner particles are supplied in a large amount so as to cover such a large toner consumption. In this case, if the supply is stopped at the time point where the toner concentration reaches the target value, the toner concentration is immediately lowered. As a result, the toner concentration is controlled in a region where the toner concentration is low. In order to prevent such a problem, the supply of toner particles is continued only when the change amount of the toner concentration is large even if the toner concentration is increased to the target value, thereby to bring the toner concentration close to the target value for control correspondingly to the toner consumption in a large range amount.

Referring to FIG. 5, several rules will be described specifically. A cell which is the second from the left and the third from the top shown in FIG. 5 shall be a first rule. In this first rule, an operation of "if an output voltage of the magnetic sensor 28 is NS and a change amount of the output voltage is NM, then a toner supply time is PL" is executed. A cell which is the third from the left and the second from the top shown in FIG. 5 shall be a second rule. In this second rule, an operation of "if an output voltage of the magnetic sensor 28 is NM and a change amount of the output voltage is NS, then a toner supply time is PL" is executed. A cell which is the fourth from the left and the second from the top shown in FIG. 5 shall be a third rule. In this third rule, an operation of "if an output voltage of the magnetic sensor 28 is NM and a change amount of the output voltage is ZR, then a toner supply time is PM" is executed. The remaining rules are deduced in the same manner.

Meanwhile, when no toner particles are supplied or when toner particles are consumed in too large amounts so that the toner concentration is at a level not more than a certain level, a copy operation is automatically stopped. The toner particles are supplied while continuing driving the developing unit 18, and the copy operation is started again when the toner concentration reaches the target value. In such a manner, the toner concentration can be always controlled properly.

Figure 7:
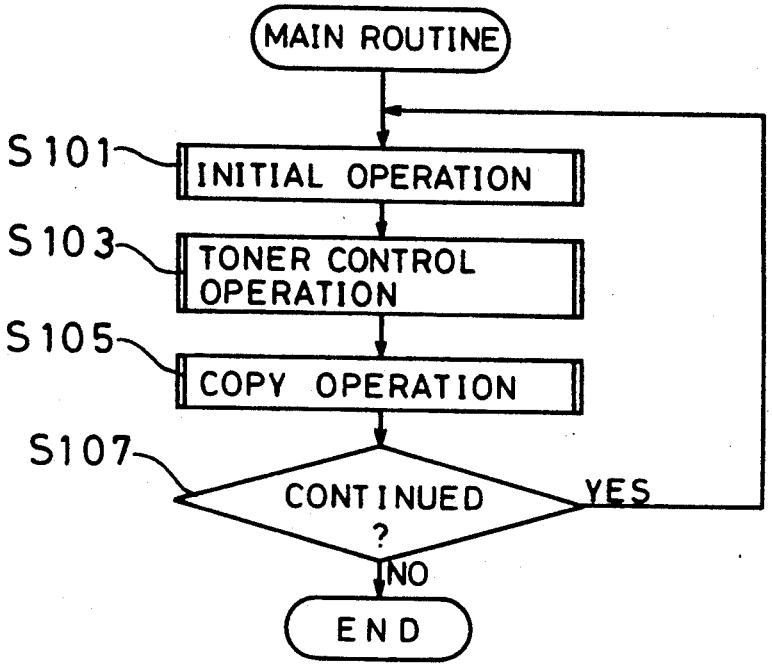
FIG. 7 is a flow chart showing an operation (a main routine) in the embodiment shown in FIGS. 1 and 3.

FIG. 7 is a flow chart showing a main routine. First, in the step S101, an initialization process such as allowance of an interruption, rotation of a main motor, and start of scanning is executed. Thereafter, in the step S103, a toner concentration is controlled, whose details will be described later with reference to FIG. 8. In the step S105, a series of copy processes is executed and then, the program proceeds to the step S107. In the step S107, it is judged whether or not continuous copy is made. The program is returned to the step S101 when the answer is in the affirmative, while a main routine is terminated when the answer is in the negative.

Figure 11:
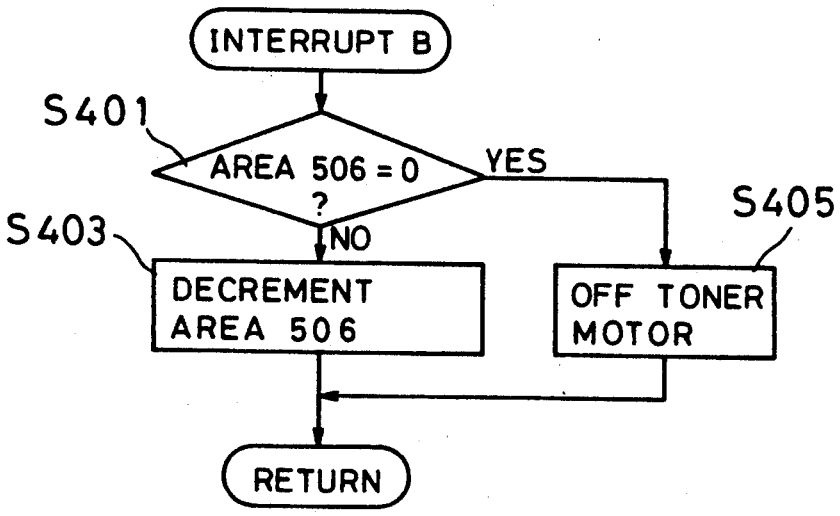
FIG. 11 is a flow chart showing an interrupt B routine in FIG. 8.
Figure 8:
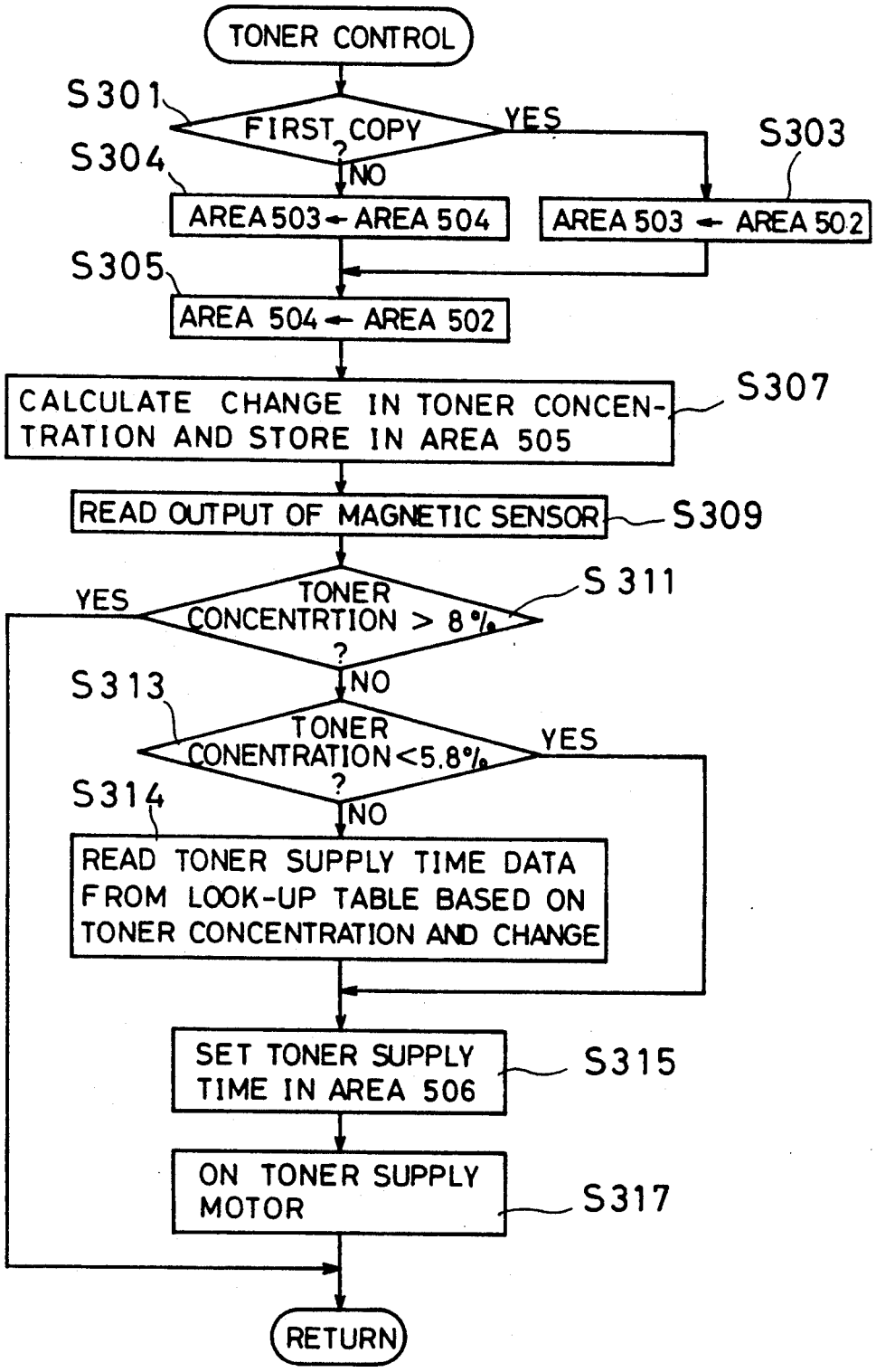
FIG. 8 is a flow chart showing a toner control subroutine in FIG. 7.
Figure 10:
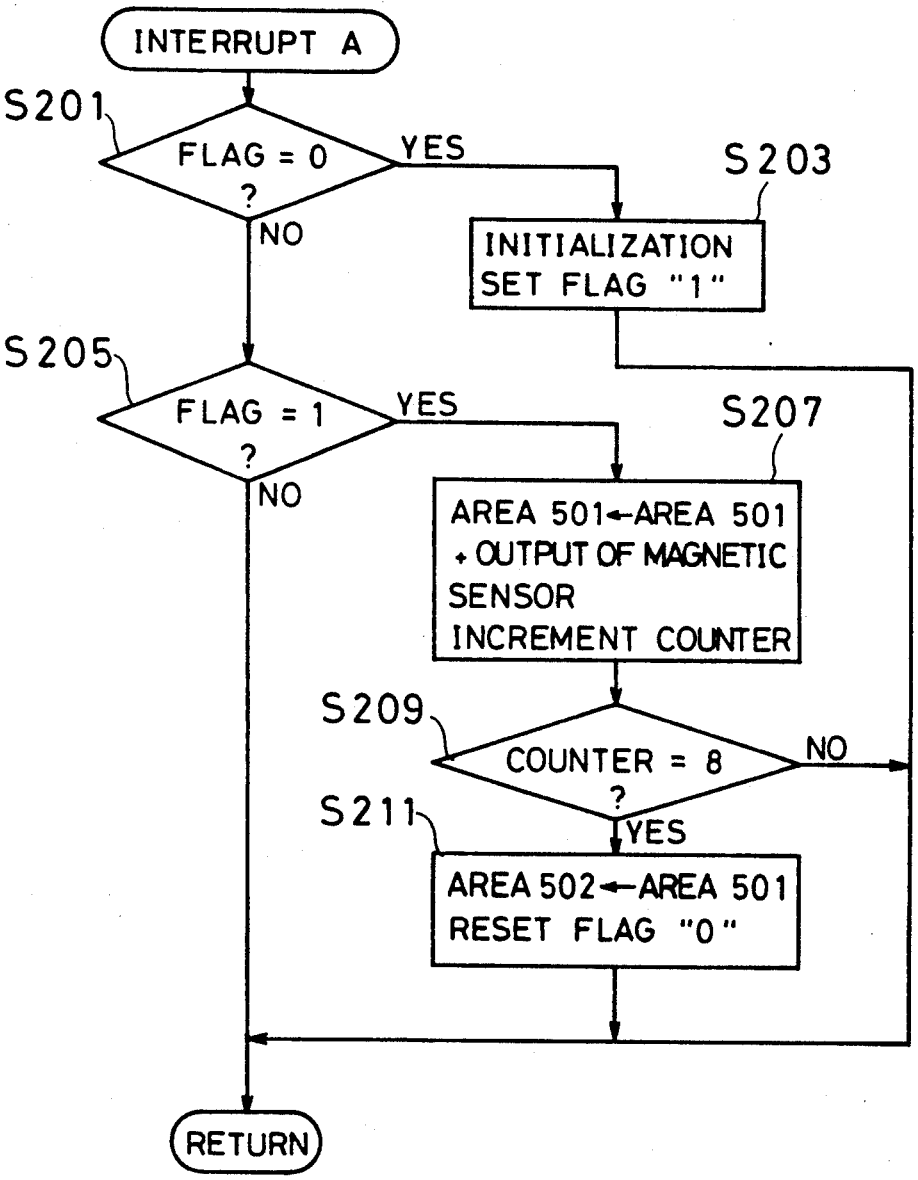
FIG. 10 is a flow chart showing an interrupt A routine in FIG. 8.

FIG. 8 is a flow chart showing a toner concentration control subroutine. FIGS. 10 and 11 respectively show a part of an interrupt routine. The interrupt routine is processed in a predetermined cycle on the basis of a time of an internal timer (not shown) in the MPU 46. In an interrupt A routine shown in FIG. 10, "the present toner concentration" required to evaluate the change amount of the toner concentration (= "the preceding toner concentration" − "the present toner concentration") is found. In the interrupt A routine, therefore, the toner concentration is added continuously eight times. Description is made with reference to FIG. 10. It is judged in the step S201 whether or not a flag provided in the area 508 in the RAM 50 is "0", and the program proceeds to the step S203 when the flag is "0". In the step S203, a counter in the RAM 50, that is, the area 507 and the area 501 are initialized and the flag in the area 508 is set to "1" and then, the program is returned to the main routine. When this interrupt A routine is then executed, it is judged that the flag area 508 in the RAM 50 is set to "1" through the steps S201 and S205, so that the program proceeds to the step S207.

In the step S207, the toner concentration in the developing unit 18, that is, the output voltage of the magnetic sensor 28 outputted from the analog-to-digital converter 54 and a value stored in the area 501 are added up and are stored in the area 501 again, and the counter area 507 is incremented. It is judged in the step S209 whether or not a count value of the counter area 507 is "8". That is, it is judged in the step S209 whether or not processing in the step S207 is performed eight times. The program is returned to the main routine when the answer is in the negative, while proceeding to the step S211 when the answer is in the affirmative. In the step S211, the value of the toner concentration (the output voltage of the magnetic sensor 28) added eight times in the step S207 is stored in the area 502 in the RAM 50, and the flag area 508 is reset. Thereafter, the program is returned to the main routine. In such a manner, "the present toner concentration" is always stored in the area 502 in the RAM 50 by the interrupt A routine.

Description is now made of a process in the step S103, that is, the toner control routine shown in FIG. 8. First, it is judged in the step S301 whether or not the first copy is made. In this first copy made immediately after the power is turned on, there is no information on "the preceding toner concentration", so that the change amount of the toner concentration cannot be evaluated. In the present embodiment, therefore, control is carried out by distinguishing the case of the first copy made immediately after the power is turned on from the case of the other copies. When it is judged in the step S301 that the answer is in the affirmative, the program proceeds to the steps S303 and S305. In the steps S303 and S305, "the preceding toner concentration" is stored in the area 503 in the RAM 50, and "the present toner concentration" is stored in the area 504 therein. At this time, the numerical value stored in the area 502 by the interrupt A routine (see FIG. 10) is stored in both the areas 503 and 504. Consequently, the change amount of the toner concentration (="the preceding toner concentration" − "the present toner concentration") becomes "the area 503 − the area 504", that is, zero.

On the other hand, when it is judged in the step S301 that the answer is in the negative, the value of the area 504 is stored in the area 503 in the step S304, thereby to set the old present toner concentration as the preceding toner concentration. In the step S305, the newest or last present toner concentration obtained by the interrupt A routine is stored in the area 504 from the area 502. In the step S309, the value of the area 504 is subtracted from the value of the area 503, and the difference is divided by 8. In the step S307, an operation of (the area 503−the area 504)/8 is executed. That is, "the present toner concentration" is subtracted from "the preceding toner concentration", to find the change amount of the toner concentration. In addition, the difference is divided by "8" to find the average value of the toner concentration because the value of the area 502 found by the interrupt A routine is a value of the results of adding the output voltage of the magnetic sensor 28 continuously eight times. The change amount of the toner concentration thus obtained is stored in the area 505 in the RAM 50 (in the step S307).

In the next step S309, the output voltage of the magnetic sensor 28 is read through the analog-to-digital converter 54 and is stored as the absolute value of the toner concentration at that time. When the range in which a fuzzy control is applied is set to the toner concentration range of approximately 5.8% to approximately 8%, the steps S311 and S313 are steps for determining whether or not the toner concentration is in the range. It is judged in the step S311 whether or not the toner concentration found in the step S309 is higher than 8%. If the answer is in the affirmative, the program is returned from this subroutine without doing anything. On the other hand, if the answer is in the negative, the program proceeds to the step S313. In the step S313, it is judged whether or not the toner concentration is lower than 5.8% in the same manner as that in the preceding step. If the answer is in the affirmative, constant time data is set as a toner supply time in the area 506 in the RAM 50, to start the toner supply motor 44 in the steps S315 and S317. That is, when the toner concentration, that is, the output voltage of the magnetic sensor 28 is outside the range in which a fuzzy inference is applied, the toner supply motor 44 is turned on for a constant time, so that constant amounts of toner particles are supplied to the developing unit 18 from the toner box 30.

Figure 9A:
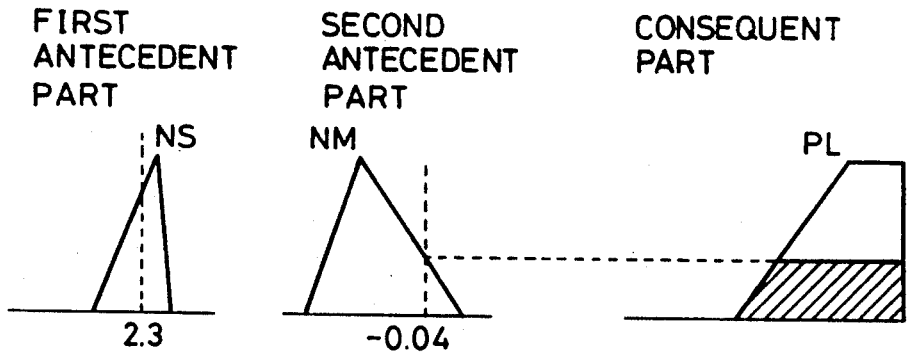
FIGS. 9A to 9D are illustrative views showing one example of a fuzzy logic inference.
Figure 9B:
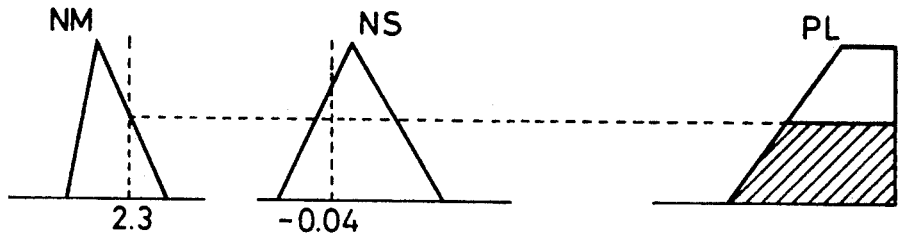
Figure 9C:
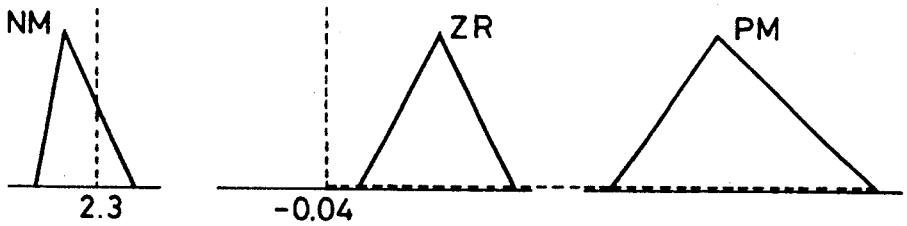
Figure 9D:
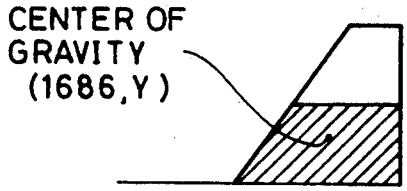

If the answer is in the negative in the step S313, the program proceeds to the step S314 so as to apply a fuzzy inference. More specifically, answers to operations of the rules shown in FIG. 5 executed using a fuzzy inference with respect to the absolute value of the toner concentration (the value of the output voltage of the magnetic sensor 28) and the change amount of the toner concentration (the change amount of the output voltage of the magnetic sensor 28), that is, toner supply time data is stored as a look-up table in the ROM 48 (see FIG. 3). For example, consider a case where the value of the output voltage of the magnetic sensor 28 is 2.3 V and the change amount thereof is −0.04 V. In this case, if the operation of the above described first rule is executed, the toner supply time is "PL" as shown in FIG. 9A. Consequently, a region hatched in FIG. 9A is obtained as an answer. If the operation of the above described second rule is executed under the same conditions, the toner supply time is "PL" as shown in FIG. 9B. Consequently, a region hatched in FIG. 9B is obtained as an answer. If the operation of the above described third rule is executed under the same conditions, the toner supply time is "PM" as shown in FIG. 9C. Consequently, a region hatched in FIG. 9C is obtained as an answer. Such operations of all the rules are executed under all the conditions, and the logical OR is carried out between the regions hatched in FIGS. 9A to 9C. As a result, a region hatched in FIG. 9D is defined. The center of gravity of the region hatched in FIG. 9D is calculated. Under the above described conditions, the X axis component of the value of the center of gravity is "1686". This numerical value is toner supply time data (1686 milliseconds). In the above described manner, the operations of all the rules are executed with respect to all the values of the output voltage of the magnetic sensor 28 and all the values of the change amounts thereof which are conceivable in the range in which a fuzzy inference is applied, and the above described center of gravity is calculated in advance and stored in the ROM 48 (see FIG. 3) in the form of a look-up table.

Toner supply time data corresponding to the change amount of the toner concentration and the absolute value of the toner concentration found in the steps S307 and S309 is read out from the look-up table. The read toner supply time data is set in the area 506 in the RAM 50 in the step S315, and the toner supply motor 44 is turned on in the step S317. In such a manner, a time for which the toner supply motor 44 is rotated is set in a variable manner based on the toner concentration and the change amount of the toner concentration in the range in which a fuzzy inference is applied.

In an interrupt B routine shown in FIG. 11, a counting operation of the toner supply time and stop processing of the toner supply motor 44 are performed. It is judged in the step S401 whether or not the contents of the area 506 are "0". Unless rotation time data of the toner supply motor 44 is set in the step S315, the contents of the area 506 are "0". If the answer is in the negative, the contents of the area 506 are decremented in the step S403, so that the program is returned. On the other hand, if the answer is in the affirmative, the program proceeds to the step S405. In this step S405, the toner supply motor 42 is stopped, so that the program is returned.

Although in the above described embodiment, a magnetic sensor is utilized as a toner concentration sensor, it is needless to say that another sensor of an arbitrary type may be used. In addition, although a look-up table is used for a fuzzy inference, operations may be executed each time by a microcomputer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

an electrostatic latent image carrying member for carrying an electrostatic latent image;

means for developing said electrostatic latent image using a dual-component developer comprising a mixture of toner particles and carrier particles;

means for sensing the toner concentration in said developer in said developing means;

means for calculating a change amount of the toner concentration based on a first toner concentration sensed by said toner concentration sensing means and a second toner concentration sensed by said toner concentration sensing means at a time after the first toner concentration was sensed;

means for setting a toner supply amount based on the change amount of the toner concentration calculated by said change amount calculating means and the second toner concentration sensed by said toner concentration sensing means; and means for supplying toner particles to said developing means in accordance with the set toner supply amount.

2. An image forming apparatus according to claim 1, wherein said toner supply amount setting means comprises fuzzy inference means for implementing a fuzzy inference so as to determine the toner supply amount.

3. An image forming apparatus according to claim 2, wherein said toner supply amount setting means comprises time setting means for setting a toner supply time based on said change amount and said second toner concentration, and said toner supplying means comprises a toner supply roller driven for said toner supply time.

4. An image forming apparatus according to claim 1, wherein said toner supply amount setting means comprises means for setting a toner supply time based on said change amount and said second toner concentration, and said toner supplying means comprises a toner supply roller driven for said toner supply time.

5. An image forming apparatus, comprising:

an electrostatic latent image carrying member for carrying an electrostatic latent image;

means for developing said electrostatic latent image using a dual-component developer comprising a mixture of toner particles and carrier particles;

means for sensing a toner concentration in said developer in said developing means;

means for instructing the sensing of a toner concentration by said toner concentration sensing means at predetermined times;

means for calculating a change amount of toner concentration based on first toner sensed and a second toner concentration sensed by said toner concentration sensing means at at time after the first toner concentration was sensed in response to instruction of said instructing means;

means for setting a toner supply amount based on the change amount of the toner concentration calculated by said change amount calculating means and the second toner concentration sensed by said toner concentration sensing means; and toner supplying means for supplying particles to said developing means in accordance with the set toner supply amount.

6. An image forming apparatus according to claim 5, wherein said toner supply amount setting means comprises fuzzy inference means for implementing a fuzzy inference so as to determine the toner supply amount.

7. An image forming apparatus according to claim 6, wherein said toner supply amount setting means comprises time setting means for setting a toner supply time based on said change amount and said second toner concentration, and said toner supplying means comprises a toner supply roller driven for said toner supply time.

8. An image forming apparatus according to claim 5, wherein said toner supply amount setting means comprises means for setting a toner supply time based on said change amount and said toner second concentration, and said toner supplying means comprises a toner supply roller driven for said toner supply time.

9. An image forming apparatus, comprising:

an electrostatic latent image carrying member for carrying an electrostatic latent image;

means for developing said electrostatic latent image using a dual-component developer comprising a mixture of toner particles and carrier particles;

means for sensing a toner concentration in said developer in said developing means;

means for instructing said sensing of a toner concentration in said developer in said developing means;

means for instructing said sensing means to sense toner concentration at predetermined times;

means for calculating a change amount of toner concentration based on first toner concentration sensed by said second toner concentration sensing means and second toner concentration sensed by said toner concentration sensing means at a time after the first toner concentration was sensed in response to instruction of said instructing means;

means for setting a toner supply amount based on the change amount of the toner concentration calculated by said change amount calculating means and the toner concentration sensed by said toner concentration sensing means;

means for determining whether or not said toner concentration is in a predetermined range; and means for supplying toner particles to said developing means in accordance with the set toner supply amount when it is determined by said determining means that said toner concentration is in said predetermined range.

10. An image forming apparatus according to claim 9, wherein said toner supply amount setting means comprises time setting means for setting a toner supply time based on said change amount and said toner concentration, and said toner supplying means comprises a toner supply roller driven for said toner supply time.

11. An image forming apparatus according to claim 9, further comprising inhibiting means for inhibiting an image from being formed when it is determined by said determining means that said toner concentration is below said predetermined range.

12. An image forming apparatus, comprising:

an electrostatic latent image carrying member for carrying an electrostatic latent image;

means for developing said electrostatic latent image using a dual-component developer comprising a mixture of toner particles and carrier particles;

means for sensing toner concentration in said developer in said developing means;

means for instructing said toner concentration sensing means to sense a toner concentration at predetermined times;

means for calculating a change amount of the toner concentration based on toner concentration sensed by said toner concentration sensing means in response to instruction by said instructing means;

means for setting a toner supply amount based on the change amount of the toner concentration calculated by said change amount calculating means and the toner concentration sensed by said toner concentration sensing means; said toner supply amount setting means including fuzzy logic inference means for implementing a fuzzy inference so as to determine the toner supply amount;

means for determining whether or not said toner concentration is in a predetermined range; and means for supplying toner particles to said developing means in accordance with the set toner supply amount when it is determined by said determining means that said toner concentration is in said predetermined range.

13. An image forming apparatus according to claim 12, wherein said toner supply amount setting means comprises time setting means for setting a toner supply time based on said change amount and said toner concentration, and said toner supplying means comprises a toner supply roller driven for said toner supply time.

14. An image forming apparatus according to claim 12, further comprising means for inhibiting an image from being formed when it is determined by said determining means that said toner concentration is below said predetermined range.

* * * * *